US007093582B2

(12) United States Patent
Magel et al.

(10) Patent No.: US 7,093,582 B2
(45) Date of Patent: Aug. 22, 2006

(54) FILTER ARRANGEMENT FOR FUEL INJECTION SYSTEMS

(75) Inventors: Hans-Christoph Magel, Pfullingen (DE); Martin Kropp, Tamm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/527,582

(22) PCT Filed: Jun. 30, 2003

(86) PCT No.: PCT/DE03/02173

§ 371 (c)(1),
(2), (4) Date: Mar. 14, 2005

(87) PCT Pub. No.: WO2004/036030

PCT Pub. Date: Apr. 29, 2004

(65) Prior Publication Data

US 2006/0005815 A1 Jan. 12, 2006

(30) Foreign Application Priority Data

Oct. 10, 2002 (DE) ..... 102 47 210

(51) Int. Cl.
*F02M 37/04* (2006.01)

(52) U.S. Cl. ..... 123/446; 123/467

(58) Field of Classification Search ..... 123/510, 123/446, 449, 500, 501, 467
See application file for complete search history.

(56) References Cited

U.S. PATENT DOCUMENTS 4,440,132 A * 4/1984 Terada et al. ..... 123/446
4,448,168 A 5/1984 Komada et al.
4,459,959 A * 7/1984 Terada et al. ..... 123/446
5,143,291 A * 9/1992 Grinsteiner ..... 239/88
5,357,929 A * 10/1994 McCandless ..... 123/446
5,632,444 A 5/1997 Camplin
6,453,875 B1 9/2002 Mahr et al.
2002/0088435 A1* 7/2002 Kropp et al. ..... 123/446
2003/0029422 A1* 2/2003 Magel ..... 123/446

FOREIGN PATENT DOCUMENTS

DE 199 10 970 A 9/2000
DE 102 18 904 A 12/2002

* cited by examiner

*Primary Examiner*—Carl S. Miller
(74) *Attorney, Agent, or Firm*—Ronald E. Greigg

(57) ABSTRACT

A fuel injection system for internal combustion engines, having a fuel injector that can be acted upon by a high-pressure fuel source includes a pressure booster, which contains a movable boosting element dividing a work chamber which can be made to communicate with the high-pressure source via a high-pressure line from a high-pressure chamber that acts on the fuel injector. The high-pressure from chamber is variable by filling and evacuating a differential pressure chamber of the pressure booster. A filter element is received in a line portion that branches off from the high-pressure line and is upstream of flow connections for filling the differential and high pressure chambers.

11 Claims, 3 Drawing Sheets

FILTER ARRANGEMENT FOR FUEL INJECTION SYSTEMS

CROSS-REFERENCE TO RELATED APPLICATIONS

This application is a 35 USC 371 application of PCT/DE 03/02173 filed on Jun. 30, 2003.

BACKGROUND OF THE INVENTION

1. Field of the Invention

Both pressure-controlled and stroke-controlled injection systems are known and can be used to supply combustion chambers of self-igniting internal combustion engines. Besides unit fuel injectors and pump-line units, reservoir injection systems (common rails) are also used. Common rails advantageously make it possible to adapt the injection pressure to the load and rpm of the engine. To achieve high specific outputs and to reduce emissions, the highest possible injection pressure is generally required.

2. Description of the Prior Art

German Patent Disclosure DE 199 10 970 A1 relates to a fuel injection system having a pressure boosting unit which is disposed between a pressure reservoir and a nozzle chamber and whose pressure chamber communicates with the nozzle chamber via a pressure line. A bypass line connected to the pressure reservoir communicates directly with the pressure line can be used for a pressurized injection. The bypass line is disposed parallel to the pressure chamber, so that it is passable regardless of the motion and position of a displaceable pressure fluid in the pressure boosting unit. With this embodiment, the flexibility of the injection is enhanced. In this embodiment, the triggering of the pressure boosting unit is done via a pressure relief of the differential pressure chamber of the pressure boosting unit.

German Patent Disclosure DE 102 18 904.8 relates to a fuel injection system. It includes a fuel injector, which can be supplied from a high-pressure fuel source, and a pressure booster device. A closing piston of the injector protrudes into a closing pressure chamber, so that the closing piston can be acted upon by fuel pressure to attain a force that acts in the closing direction on the closing piston. A closing pressure chamber and a differential pressure chamber of the pressure booster device are formed by a common closing pressure differential pressure chamber, and all the portions of the closing pressure differential pressure chamber communicate permanently with one another to exchange fuel, so that despite an only slight pressure boost by the pressure booster device, a relatively low injection opening pressure is attainable.

In this embodiment, the pressure boosting unit is triggered by pressure relief of the differential pressure chamber of the pressure booster by means of a switching valve. This is more favorable in terms of the depressurization losses.

Fuel injectors of fuel injection systems which include high-pressure reservoirs have very small throttles and valve opening cross sections. In these fuel injectors, for satisfactory assurance of function, a filter element is necessary upstream of the fuel injector. With it, even the tiniest contamination particles that can get into the system, for instance during the installation of the system parts, are kept away from the vulnerable components. At present, rod-filters are typically used and are inserted into the high-pressure line connection neck.

A disadvantage of the use of rod filters in fuel injectors of fuel injection systems that include a high-pressure reservoir and a pressure boosting unit to increase the pressure level is the high volumetric flow of fuel that flows from the high-pressure reservoir to the fuel injector during the brief injection phase. As a result, severe throttling occurs when filter elements embodied as rod filters are used, resulting in a not inconsiderable pressure loss. This worsens the system efficiency and impairs the maximum injection pressure. To avoid this, rod filters used as filter elements must be made relatively large. Yet relatively large rod filters cannot be accommodated in the installation space available.

SUMMARY OF THE INVENTION

In fuel injection systems that include both a high-pressure connection and pressure booster which is controlled by subjecting a differential pressure chamber to pressure or relieving that chamber of pressure, it is possible according to the invention to integrate a filter element in such a way that during the injection, no throttling losses that impair the attainable maximum injection pressure occur. Thus the actual maximum injection pressure, at which the fuel is injected into the combustion chamber of the engine, can be increased. An increase in the efficiency of the fuel injection system is also attainable.

The filter element, which is required to filter out the tiniest contamination particles that can get into the fuel injection system, for instance when its individual components are assembled, is directly accommodated in a branch off the high-pressure line that acts upon a work chamber of the pressure booster, or in a branch off the work chamber. In the branch that receives the filter element, the volumetric flow of fuel is considerably less. The long duration of the injection pause between injections is available here, in which the fuel quantity for filling the pressure chambers flows through the filter element upon restoration of the pressure booster. In the supply stroke of the pressure booster, no fuel has to flow via the filter element. Conversely, the work chamber of the pressure booster is acted upon by unfiltered fuel, which is at high pressure, and this is done without throttling by a filter element.

In a first variant embodiment, the filter element can be located upstream of flow connections by way of which a differential pressure chamber of the pressure booster and its high-pressure chamber are re-filled with fuel in the restoration phase of a boosting element received in the pressure booster and configured in pistonlike fashion. This assures that the fuel, compressed in accordance with the boosting ratio of the pressure booster, that flows out into the fuel injector is free of contaminants, so that all the vulnerable throttles, valve cross sections, and in particular the valve seats are protected. This applies to all the regions of the fuel injector located downstream of the pressure booster.

Alternatively, the filter element can be disposed upstream of a switching valve that actuates the pressure booster. The filter element is integrated into the supply line to the switching valve in such a way that all the regions of the fuel injector, except for the work chamber of the pressure booster, are supplied with filtered fuel. Moreover, the switching valve, which may have sealing seats and, in a servo-hydraulic version, also throttles with very small throttle cross sections, can be protected against contaminants.

The filter element for filtering out contaminants from the fuel is accommodated in flow lines, which in comparison to the high-pressure lines that act upon the work chamber of the pressure booster carry considerably lesser volumetric flows of fuel, preferably from about one fifth (⅕) to about one twentieth (1/20) of the total flow. The fuel quantity that is needed to refill the differential pressure chamber and the high-pressure chamber of the pressure booster flows via the filter element, during the pause between injections, which is long in comparison to the injection phase itself. A smaller volumetric flow therefore occurs here than in the supply line to the work chamber during the injection phase. During the injection, no fuel flow via the filter element is necessary.

As a result, there are no throttling losses during the injection, and all the vulnerable, close-tolerance components of the fuel injector are effectively protected against damage and leaks from deposits of particles. In a space-saving variant, the filter element, a check valve in the bypass line of the pressure booster, a throttle restriction, and a filling valve can all be integrated with the boosting element of the pressure booster.

BRIEF DESCRIPTION OF THE DRAWINGS

The invention will be described in further detail below in conjunction with the drawings, in which.

DESCRIPTION OF THE PREFERRED EMBODIMENTS

Figure 1:
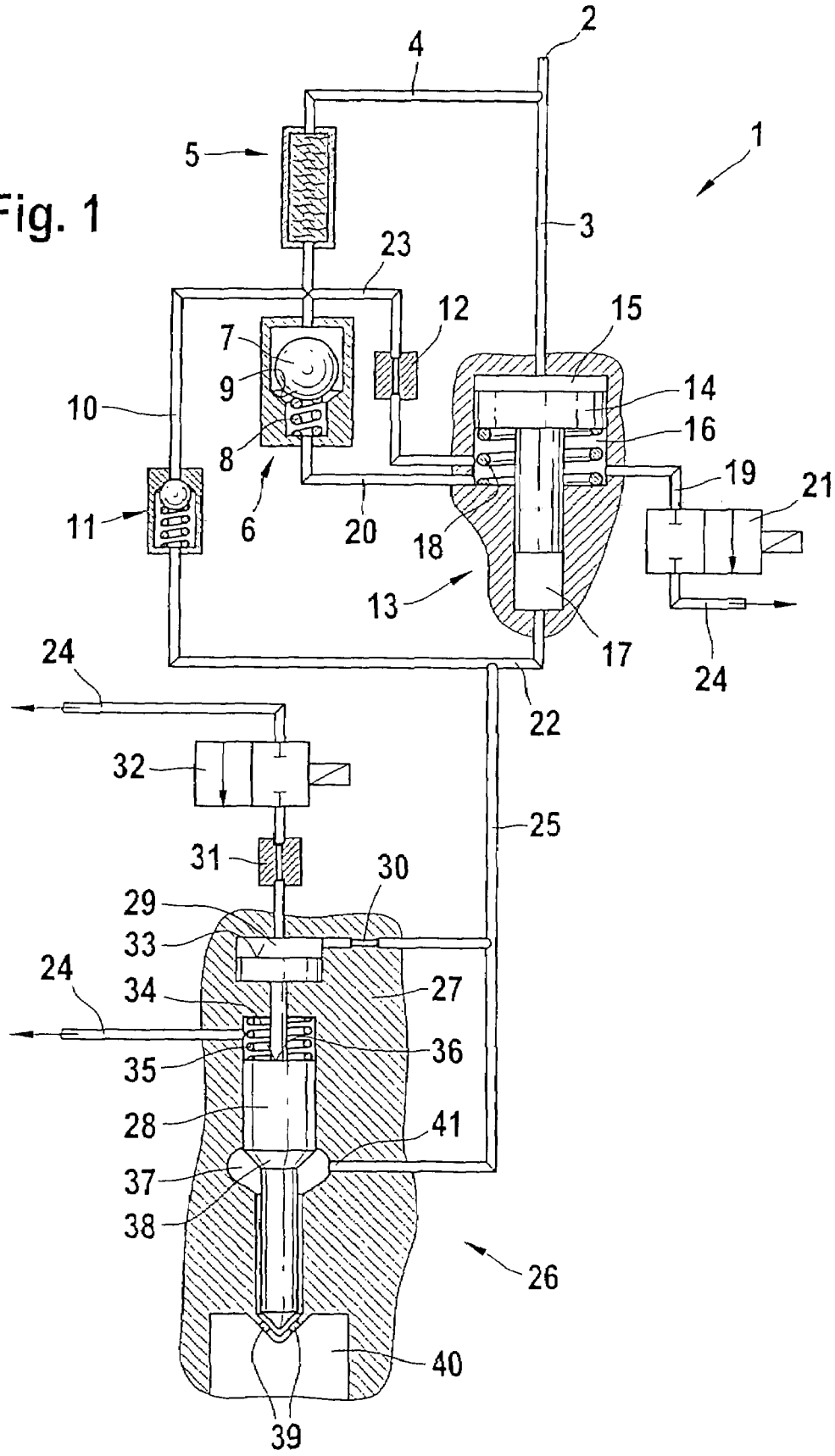
FIG. 1 is a schematic view, partly in section, of one exemplary embodiment of a disposition of the filter element, upstream of flow connections that serve to refill pressure chambers of a pressure booster.

FIG. 1 shows the illustration of an exemplary embodiment in which a filter element is upstream of the filling lines of pressure chambers of a pressure booster. From this illustration, a fuel injection system 1 can be seen, which is acted upon, via a high-pressure source, not shown in FIG. 1, with fuel that is at high pressure. The high-pressure source is connected to a high-pressure connection 2 of a high-pressure line 3 and acts directly upon a work chamber 15 of a pressure booster 13, without throttling.

From the high-pressure line 3, a line portion 4 in which a filter element 5 is received branches off. In comparison to the volumetric flow of fuel that flows through the high-pressure line 3 to the work chamber 15 of the pressure booster 13, the fuel volume that passes through the line portion 4 is slight.

After passing through the filter element 5, the volumetric flow of fuel passing through the line portion 4 flows to the parallel-connected flow conduits 10, 20 and 23.

Via the first flow conduit 10, which includes a check valve 11, there is a flow connection between the line portion 4, containing the filter element 5, and the high-pressure chamber 17 of the pressure booster 13. Via a second flow conduit 20, in which a filling valve 6 is disposed, there is a flow connection between the line portion 4, containing the filter element 5, and a differential pressure chamber 16 of the pressure booster 13. A restoring spring 18 is disposed in the differential pressure chamber 16 of the pressure booster 13 and acts upon a pistonlike boosting element 14, embodied in one piece in the illustration in FIG. 1. Connected parallel to the second flow conduit 20 is a third flow conduit 23, which includes a throttle restriction 12, so that the differential pressure chamber 16 of the pressure booster 13 can be acted upon with fuel via the parallel-connected flow conduits 20 and 23.

The pressure booster 13, which is actuatable by means of a pressure relief of the differential pressure chamber 16, is activated and deactivated via a switching valve 21 that can be embodied as a magnet valve. The switching valve 21 communicates with a low-pressure-side return 24, which discharges into a fuel tank, not shown in FIG. 1, of a vehicle.

An inlet or outlet 22, through which the flow can be in the inflow direction or the outflow direction—relative to a fuel injector 26—extends from the high-pressure chamber 17 of the pressure booster 13. The inlet or outlet 22 changes over into a high-pressure line 25 with which the fuel, brought to an elevated pressure level in accordance with the dimensioning of the pressure booster 13, is delivered to the fuel injector 26.

From the high-pressure line 25, an inlet throttle 30 that acts on a control chamber 29 of the fuel injector 26 branches off. The inlet throttle 30 is integrated with an injector body 27 of the fuel injector 26. Through the inlet throttle 30, the control chamber 29 of the fuel injector 26 is filled with fuel. A pressure relief of the control chamber 29 is effected via an outlet throttle 31, whose closing member, not shown in FIG. 1, that closes the control chamber 29 can be actuated via a further switching valve 32. The further switching valve 32 may be embodied as a magnet valve or as a piezoelectric actuator. The fuel entering the control chamber 29 via the inlet throttle 30 acts upon an end face 33 of an injection valve member 28, which is received movably in the injector body 27 of the fuel injector 26. The injection valve member 28 is preferably embodied as a nozzle needle. A nozzle spring chamber 34 is also disposed in the injector body 27. A spring element 35 is received in the nozzle spring chamber 34, which is formed on one side by the wall of the injector body 27 and on the other by an annular face 36 of the injection valve member 28. From the nozzle spring chamber 34 of the injector body 27, upon a vertically upward-oriented opening motion of the injection valve member 28, a fuel volume flows via the differential pressure chamber 34 to the low-pressure side of the fuel injection system 1.

The high-pressure line 25, which can be acted upon via the high-pressure chamber 17 of the pressure booster 13, discharges at an orifice 41 into a nozzle chamber 37, embodied in the injector body 27 of the fuel injector 26. In the region of the nozzle chamber 37, the injection valve member 28 includes a frustoconical pressure shoulder 38. From the nozzle chamber 37, the fuel, delivered to it via the orifice 41, flows, via an annular gap embodied on the end toward the combustion chamber of the fuel injector 26, to injection openings 39, by way of which the fuel, which is at high pressure, is delivered to a combustion chamber 40 of an internal combustion engine. On the end of the fuel injector 26 toward the combustion chamber, one or more injection openings 39 may be embodied. The injection openings 39 may also be embodied annularly, in rings that are concentric to one another, on the end toward the combustion chamber of the fuel injector 26, so that uniform atomization of the fuel that is at high pressure is assured upon injection into the combustion chamber 40 of the engine.

Via the fuel source, not shown in FIG. 1, communicating at the high-pressure connection 2 with the high-pressure line 3, the fuel is present without throttling by a filter element in the work chamber 15 of the pressure booster 13. The spring 18 integrated with the differential pressure chamber 16 of the pressure booster 13 tends to keep the pistonlike boosting element 14 in its position of repose. The pressure booster 13 is activated by opening of the switching valve 21. When the differential pressure chamber relief line 19 is made to communicate with the low-pressure-side return 24, fuel flows out of the differential pressure chamber 16 of the pressure booster 13. Because of the high pressure prevailing in the work chamber 15, the pistonlike boosting element 14 moves into the high-pressure chamber 17. Because of the pistonlike boosting element 14, in accordance with the design of the pressure booster 13, an increased fuel pressure results in the high-pressure chamber 17, and this fuel pressure is delivered via the inlet or outlet 22, as applicable, to the fuel injector 26 or its control chamber 29 and its nozzle chamber 37. During the injection event, the fuel flows unthrottled, without filtering, via the high-pressure line 3 to the work chamber 15 of the pressure booster 13. The fuel compressed in the high-pressure chamber 17 of the pressure booster 13 is injected. After the termination of the injection event, a restoring motion of the pistonlike boosting element 14 into its position of repose is effected, because of the actuation of the switching valve 21 and by means of the spring 18 that is let into the differential pressure chamber 16. During the injection event, the check valve 11 disposed in the first flow conduit 10 prevents fuel, which is at elevated pressure, from flowing back into the line portion 4, containing the filter element 5, that branches off from the high-pressure line 3. During the restoring motion of the pistonlike boosting element 14, fuel flows into the high-pressure chamber 17 of the pressure booster 13 to replenish it, via the first flow conduit 10 that is downstream of the filter element 5. Simultaneously, via the second flow conduit 20 containing the filling valve 6 and via the third flow conduit 23, containing the throttle restriction 12 and connected parallel to the second flow conduit 20, fuel filtered by the filter element 5 in the line portion 4 flows into the differential pressure chamber 16 of the pressure booster 13 to replenish it. Thus all the components of the fuel injector located downstream of the pressure booster 13, and in particular both the inlet throttle 30 and the outlet throttle 31, as well as the nozzle chamber 37 in the injector body 27 and the injection openings 39 on the end of the fuel injector 26 toward the combustion chamber are acted upon only by filtered fuel.

Figure 2:
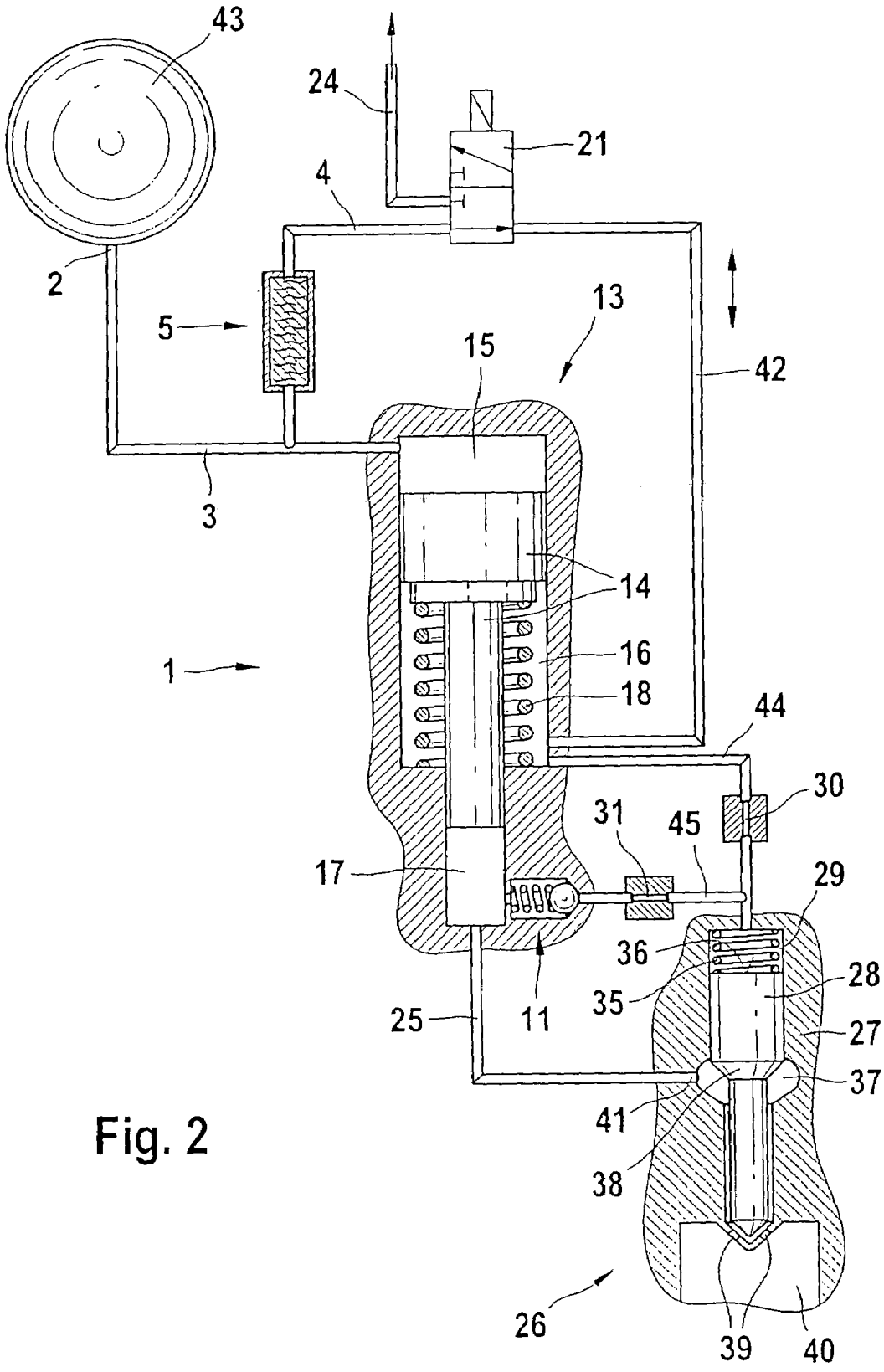
FIG. 2 is a further exemplary embodiment in which a filter element, located outside a high-pressure line, is upstream of a switching valve that actuates the pressure booster.

From the illustration in FIG. 2, a further exemplary embodiment can be seen, in which a filter element is disposed upstream of a switching valve that actuates the pressure booster.

In the variant embodiment shown in FIG. 2, the high-pressure line 3 is acted upon by fuel at high pressure from a high-pressure reservoir 43 (common rail). The fuel at high pressure enters the high-pressure line 3 at the high-pressure connection 2 and flows, unthrottled, via the high-pressure line to the work chamber 15 of the pressure booster 13. A larger volumetric flow of fuel flows in the high-pressure line 3 from the common rail 43 to the work chamber 15, compared to the volumetric flow of fuel that passes through the line portion 4 that receives the filter element 5. In the exemplary embodiment of FIG. 2, the line portion 4 acts as the supply line to the switching valve 21 that activates the pressure booster 13. The switching valve 21 includes a connection to the low-pressure-side return 24 on one side and an overflow line 42 on the other; as indicated by the double arrows in FIG. 2, fuel can flow through the overflow line in both directions, depending on the switching position of the switching valve 21. In the view shown in FIG. 2, the pistonlike boosting element 14 of the pressure booster 13 is embodied in two parts. Via the overflow line 42, the differential pressure chamber 16 of the pressure booster 13 is acted upon by fuel at high pressure. The spring element 18 is let into the differential pressure chamber 16 of the pressure booster 13 and keeps the pistonlike boosting element 14 in its position of repose. The pistonlike boosting element 14 acts with its end face remote from the work chamber 15 upon the high-pressure chamber 17. From the high-pressure chamber 17 of the pressure booster 13, the high-pressure line 25 extends to the nozzle chamber 37 and discharges into it at the orifice 41. In addition, the high-pressure chamber 17 of the pressure booster 13 is in communication with a filling line 44, via a refilling branch 45. Via the filling line 44, the differential pressure chamber 16 of the pressure booster 13 and the control chamber 29 of the fuel injector 26 communicate fluidically with one another. Unlike the exemplary embodiment of FIG. 1, the spring element 35 is let into the control chamber 29 of the fuel injector 26 as shown in FIG. 2, the spring element is braced on a boundary face of the control chamber 29 and acts on the end face 36 of the injection valve member 28, which can be embodied as a nozzle needle. The inlet throttle 30 is integrated with the filling line 44, while the refilling branch, which connects the high-pressure chamber 17 with the filling line 44, contains both the outlet throttle 31, for pressure relief of the control chamber 29, and a check valve serving to fill the high-pressure chamber 17.

The fuel, at elevated fuel pressure flowing via the high-pressure line 25 into the nozzle chamber 37 at the orifice 41 flows from the nozzle chamber 37 toward injection openings 39, via an annular gap embodied on the end toward the combustion chamber of the fuel injector 26. Via the injection openings 39, a plurality of which can be disposed on the end of the fuel injector 26 toward the combustion chamber, either in offset relationship to one another or in annular concentric circles, the fuel flowing in from the nozzle chamber 37 of the fuel injector 26 upon opening of the injection valve member 28 is injected into the combustion chamber 40 of the engine.

With the exemplary embodiment shown in FIG. 2, throttling losses during injection can be avoided, and thus extremely high pressures can be achieved in injection, since from the high-pressure reservoir 43, fuel flows unthrottled into the work chamber 15 of the pressure booster 13 via the high-pressure line 3. The volumetric flow of fuel in the high-pressure line during the injection of fuel through the fuel injector 26 is considerably higher than that which passes through the line portion 4, containing the filter element 5, that acts as a supply line to the switching valve 21. Because of the disposition of the filter element 5, which is upstream of the switching valve 21 in the second exemplary embodiment, all the parts of the pressure booster 13—except for the work chamber 15—downstream of the switching valve 21 are acted upon by fuel filtered via the filter element 5. In particular the control valve 21, which can have sealing seats and, in a servo-hydraulic version, small throttles with extremely small throttling cross sections, are protected against contaminants by the disposition according to the invention of the filter element 5 in a line—such as the supply line 4—that carries a lesser volumetric flow of fuel.

The fuel injection system 1 shown in FIG. 2 is shown in its deactivated state. Via the switching valve 21, switched into its position of repose, fuel flows via the line portion 4, acting as a supply line to the switching valve 21 and containing the filter element 5, via the overflow line 42 into the differential pressure chamber 16 of the pressure booster 13. Simultaneously, its work chamber 15 is acted upon by the unthrottled fuel stream passing through the high-pressure line 3. Via the spring 18 disposed in the differential pressure chamber 16 of the pressure booster 13, the pistonlike boosting element 14, which divides the work chamber 15 from the differential pressure chamber 16, is kept in its position of repose. Via the filling line 44, the pressure level prevailing in the differential pressure chamber 16 of the pressure booster 13 also prevails in the control chamber 29 of the fuel injector 26. Filtered fuel flows to chamber 29 via the inlet throttle 30. A refilling branch 45, which contains the check valve 11, branches off from the filling line 44. By means of the refilling branch, the high-pressure chamber 17 is acted upon by filtered fuel that has been cleaned of contaminants. Via the high-pressure line 25 that branches off from the high-pressure chamber 17, the pressure level prevailing in the high-pressure reservoir 43 prevails in the nozzle chamber 37 of the fuel injector 26 as well.

An actuation of the pressure booster 13 is effected by switching the switching valve 21 into its activated position, or in other words upon communication of the overflow line 42 with the low-pressure-side return 24. As a result, the control volume contained in the differential pressure chamber 16 of the pressure booster 13 flows away in the direction of the low-pressure-side return 24. Because of the high pressure prevailing in the work chamber 15, the pistonlike boosting element 14, embodied in two parts as shown in FIG. 2, moves with its lower face end into the high-pressure chamber 17. As a result, fuel flows from the high-pressure chamber 17 at an elevated pressure level to the nozzle chamber 37 via the high-pressure line 25, while via the filling line 44, fuel is positively displaced out of the control chamber 29 of the fuel injector. Because of the pressure level, boosted in accordance with the design of the pressure booster 13, that prevails in the high-pressure chamber 17, the hydraulic area of the pressure shoulder 38 on the injection valve 28 becomes operative there, so that with its face end 36, the injection valve 28 moves into the control chamber 29, and the fuel is injected into the combustion chamber 40 of the engine via the opened injection openings 39.

A termination of the injection event is effected by moving the switching valve 21 into its closing position shown in FIG. 2, in which the differential pressure chamber 16 of the pressure booster 13 is filled with fuel via the overflow line 42 via the line portion 4 and the filter element 5 contained in the line portion. This fuel has passed through the filter element 5 which is disposed in the line portion 4 and filters out contaminants from the fuel. The filling of the differential pressure chamber 16 of the pressure booster 13 is effected by way of supplying fuel into the differential pressure chamber 16. Via the filling line 44 that connects the differential pressure chamber 16 with the control chamber 29 of the fuel injector 26, replenishing filtered fuel simultaneously flows into the high-pressure chamber 17 via the refilling branch 45, which includes a throttle restriction 31. The throttle restriction 31 limits the filling quantity flowing to the high-pressure chamber 17. At the end of injection, the throttle restriction 31 assures a phase of overpressure in the control chamber 29, which acts as a nozzle closing chamber, relative to the nozzle chamber 37, and as a result an accelerated needle closure ensues.

The refilling of the differential pressure chamber 16 and the refilling of the high-pressure chamber 17 of the pressure booster 13 are effected in parallel via the overflow line 42 and the filling line 44 as well as the refilling branch 45 between the high-pressure chamber 17 and the filling line 44. The check valve 11 has the task of preventing a pressure drop in the high-pressure chamber 17 during the injection, so that the fuel volume, which is at an elevated pressure, that flows out of the high-pressure chamber enters the nozzle chamber 37 of the fuel injector via the high-pressure line 25 without losses. During the injection, the closing body, for instance embodied as a ball, of the check valve 11 is put into its valve seat and closes the refilling branch 45.

Unlike the variant embodiment of FIG. 1, in the embodiment of FIG. 2 the triggering of the fuel injection system 1 is done with a switching valve 21. Because of the disposition of the filter element 5 in the line portion 4, acting as a supply line, to the switching valve 21, it is assured that the switching valve 21 and all the components of the pressure booster 13 located downstream of the switching valve 21—with the exception of the work chamber 15—as well as the components of the fuel injector 26 are acted upon by filtered fuel. The disposition of the filter element 5 in a line portion 4, which carries a lesser fuel volume than the volumetric flow of fuel which flows through the high-pressure line 3 acting on the work chamber 15 of the pressure booster 13 during the injection, assures that no throttling losses occur at the filter element 5 during the injection. The volumetric flow of fuel for refilling the pressure chambers 16 and 17 of the pressure booster 13 can be considered slight, with respect to the volumetric flow that passes through the high-pressure line 3 to the work chamber 15 of the pressure booster 13. This volumetric flow required to refill chambers 16, 17 may be within the range of about one fifth (1/5) to about one twentieth (1/20) of the total flow through conduit 3.

On the one hand, by the disposition of the filter element 5 proposed according to the invention, the throttling losses during the injection, which can cause an impairment in the maximum attainable injection pressure, can be reduced considerably; on the other hand, by the provisions proposed by the invention in the two variant embodiments described, it is assured that the vulnerable throttle cross sections and valve seats can be protected against the deposit of contaminants contained in the fuel, or contaminants that get into the fuel injection system 1 during assembly. As a result, the service life of a fuel injection system 1 configured according to the invention can be lengthened considerably, and its operating safety and reliability can be enhanced.

As an alternative to the disposition of the filter element 5 of the check valve 11, the throttle restriction 12, and the filling valve 6, all located outside the pressure booster 13 in FIG. 1, these components and their flow connections, that is, the flow conduits 10, 20 and 23, may also be received inside the pistonlike boosting element 14 of the pressure booster 13. This makes an especially space-saving embodiment of the fuel injection system possible. In the variant embodiment shown in FIG. 3, the pressure booster 13 of the fuel injection system 1 includes a pistonlike boosting element 14 in which both the filter element 5 and downstream of it in the first flow conduit 10 the filling valve 6 and in the third flow conduit the throttle restriction 12 are connected. Via the throttle restriction 12 integrated with the third flow conduit 23, an imposition of pressure of a filling of the differential pressure chamber 16 of the pressure booster 13 is effected. The filling valve 6downstream of the filter element 5 is in communication, via a branch 47, with the differential pressure chamber 16 of the pressure booster 13. A through conduit 46, in which the check valve 11 is received, extends below the filling valve 6. The through conduit 46 discharges at the lower face end, defining the high-pressure chamber 17, of the pistonlike boosting element 14. An actuation of the pressure booster 13 is effected by means of a pressure relief of the differential pressure chamber 16 of the pressure booster 13, by triggering the switching valve 21 into an open position, so that the fuel contained in the differential pressure chamber 16 flows out into the low-pressure-side return 24.

Upon the motion of the pistonlike boosting element 14 inward into the high-pressure chamber 17, the check valve 11 is forced into its closing position, so that no pressure loss occurs in the high-pressure chamber 17 of the pressure booster 13. Accordingly, fuel compressed in the high-pressure chamber flows via the inlet 22 of the high-pressure line 25 to the nozzle chamber 37. Via a line portion that branches off from the inlet 22, the control chamber 29 of the fuel injector 26 is acted upon. A pressure relief of the control chamber 29 of the fuel injector 26 is effected by a triggering of the switching valve 32 into its open position, so that via the throttle restriction 30, fuel flows out into the low-pressure-side return 24, and the control chamber 29 of the fuel injector 26 is pressure-relieved. Because of the fuel, at extremely high pressure, flowing into the nozzle chamber 37 via the high-pressure line 25, a pressure acting in the opening direction of the injection valve member 28 builds up at the pressure shoulder 38 of the injection valve member 28. The injection valve member 28 moves upward, counter to the action of the spring 35 received in a nozzle spring chamber 34, and uncovers the injection openings 39 on the end toward the combustion chamber.

Figure 3:
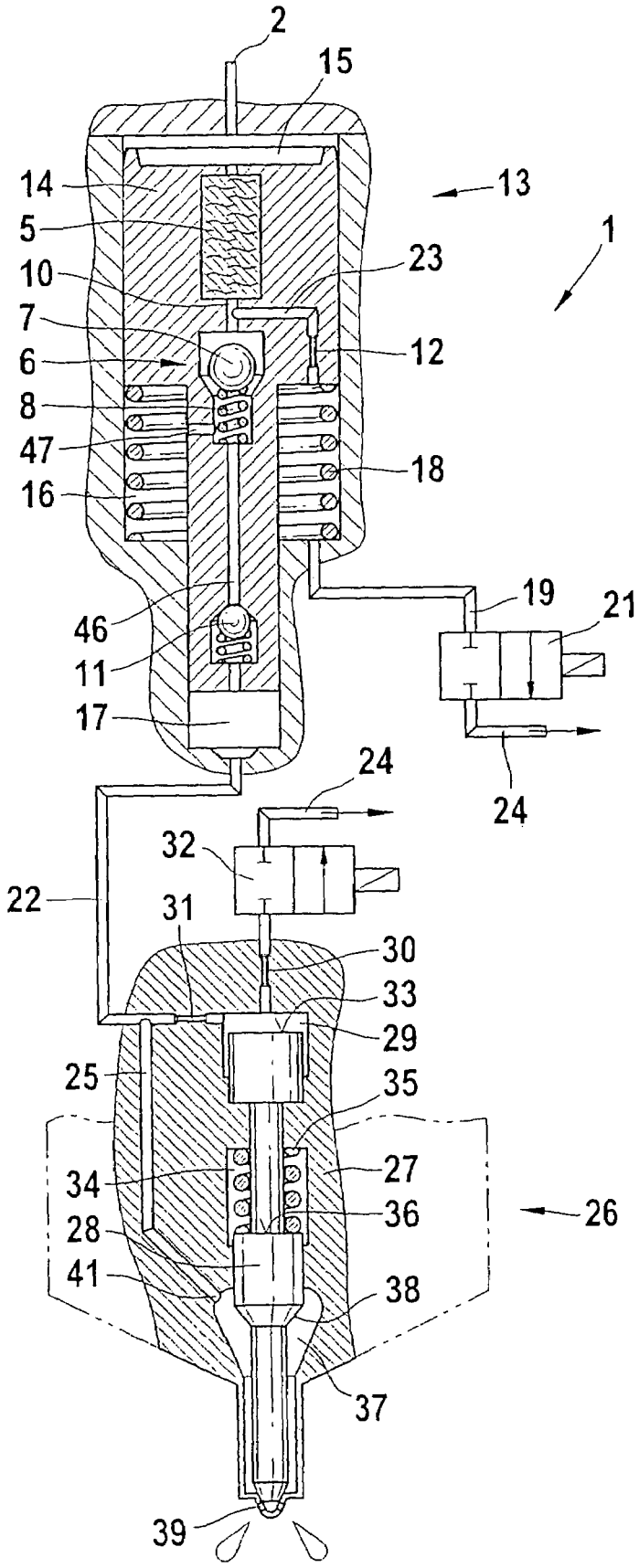
FIG. 3 shows a filter element integrated into a pressure booster piston of the pressure booster.

If conversely the switching valve 21 that connects the differential pressure chamber 16 with the low-pressure-side return 24 is actuated into its closing position in FIG. 3, refilling of the differential pressure chamber 16 of the pressure booster 13 is effected via the flow conduits 10 and 23, downstream of the filter element 5, in which flow conduits the filling valve 6 and the throttle restriction 12, respectively, are integrated. The refilling of the differential pressure chamber 16 is effected parallel via the third flow conduit 23 with the throttle restriction 12 and via the branch 47 from the filling valve 6 that discharges into the differential pressure chamber 15. Simultaneously, the high-pressure chamber 17 is filled via the check valve 11, which upon an upward motion of the pistonlike boosting element 14—reinforced by the restoring spring 18 received in the differential pressure chamber 16—fuel flows via the through conduit 46 into the high-pressure chamber 46 to refill it.

The foregoing relates to a preferred exemplary embodiment of the invention, it being understood that other variants and embodiments thereof are possible within the spirit and scope of the invention, the latter being defined by the appended claims.

The invention claimed is:

1. A fuel injection system for internal combustion engines, comprising a fuel injector (26) that can be acted upon by a high-pressure fuel source (2, 43), a pressure booster (13) including a work chamber (15), a high pressure chamber (17), a differential pressure chamber (16), and a movable pressure boosting element (14), the pressure booster being disposed between the fuel injector (26) and the high-pressure source (2, 43), the pressure boosting element (14) dividing the work chamber (15), which can be made to communicate with the high-pressure source (2, 43) via a high-pressure line (3), from the high-pressure chamber (17) that acts upon the fuel injector (26), means filling the differential pressure chamber (16) of the pressure booster (13) with fuel and evacuating the differential pressure chamber (16) of fuel during restoration and pressure boosting phases, respectively, to thereby vary the pressure in the high pressure chamber (17)

a filter element (5) connected in a line portion (4) branching from high pressure line (3) upstream of at least one of the chambers (15, 16, 17) of the pressure booster and upstream of the flow conduits (10, 20, 23; 42, 44) for filling at least one of the pressure chambers (16, 17) of the pressure booster (13), wherein the line portion (4) containing the filter element (5) changes over into flow conduits (10, 20, 23) for filling the differential pressure chamber (16) and the high-pressure chamber (17) of the pressure booster (13).

2. The fuel injection system of claim 1, wherein fuel from the high-pressure source (2, 43) enters the work chamber (15) the pressure booster (13) via the high-pressure line (3), without passing through the filter element (5).

3. The fuel injection system of claim 1, further comprising a check valve (11) in a first flow conduit (10) whereby filtered fuel flows into the high-pressure chamber (17) to replenish it via the first flow conduit (10) during the restoration phase of the pressure boosting element (14).

4. The fuel injection system of claim 1, wherein during the restoration phase of the pressure booster (14), the differential pressure chamber (16) can be filled with filtered fuel via second and third flow conduits (20, 23).

5. The fuel injection system of claim 4, wherein the second flow conduit (20) includes a filling valve (6).

6. The fuel injection system of claim 4, wherein the third flow conduit (23) includes a throttle restriction.

7. The fuel injection system of claim 1, wherein the volumetric flow of fuel that flows through the line portion (4) that contains the filter element (5) is from about one-fifth (1/5) to about one-twentieth (1/20) of the total fuel flow flowing in the high-pressure line (3).

8. The fuel injection system of claim 1, wherein the line portion (4) that contains the filter element (5) acts as the supply line to a switching valve (21), which communicates with an overflow line (42) that discharges into the differential pressure chamber (16) of the pressure booster (13).

9. The fuel injection system of claim 8, further comprising a filling line (44) for filling a control chamber (29) of the fuel injector (26), which filling line (44) includes a throttle restriction (30) and extends from the differential pressure chamber (16).

10. The fuel injection system of claim 9, further comprising a refilling branch (45) that includes a throttle restriction (31), the filling branch (45) extending from the filling line (44) to the high-pressure chamber (17) of the pressure booster (13).

11. The fuel injection system of claim 9, wherein a control volume positively displaced by the injection valve member (28) flows out of the control chamber (29) into the differential pressure chamber (16) via the filling line (44) when the pressure booster (13) is in the activated state, and into the control chamber (29) when the pressure booster (13) is in its position of repose.

* * * * *